US005619612A

United States Patent [19]

Glucksman et al.

[11] Patent Number: 5,619,612

[45] Date of Patent: Apr. 8, 1997

[54] ELECTRIC AIR HEATER WITH CAGE-SHAPED HEATING ELEMENT COMPRISED OF RESISTANCE ALLOY STRIPS AND INCLINED GUIDE VANES

[75] Inventors: Dov Z. Glucksman, Wenham; John A. Deros, Salem, both of Mass.

[73] Assignee: Appliance Development Corp., Danvers, Mass.

[21] Appl. No.: 182,223

[22] Filed: Jan. 18, 1994

[51] Int. Cl.[6] ..... H05B 1/00; F24H 3/04

[52] U.S. Cl. ..... 392/360; 392/365; 338/294; 338/58

[58] Field of Search ..... 392/360–385; 338/294, 58

[56] References Cited

U.S. PATENT DOCUMENTS

| | | | |
|---|---|---|---|
| 1,544,730 | 7/1925 | Dressler | 392/365 |
| 1,979,883 | 11/1934 | Hynes | 392/365 |
| 2,158,604 | 5/1939 | Calhoun | 392/365 |
| 4,090,061 | 5/1978 | Glucksman | 392/379 |
| 4,694,142 | 9/1987 | Glucksman | 392/360 |

FOREIGN PATENT DOCUMENTS

| | | | |
|---|---|---|---|
| 293997 | 12/1988 | European Pat. Off. | 392/379 |
| 133882 | 1/1979 | Germany | 392/379 |
| 3204298 | 8/1983 | Germany | 392/379 |

*Primary Examiner*—John A. Jeffery
*Attorney, Agent, or Firm*—Sofer & Haroun, LLP

[57] ABSTRACT

A motor is located in the air inlet area is enclosed in a shock proof housing. The housing is of a cylindrical configuration, comprising a solid rear wall and a front wall which contains air inlet openings small enough to prevent access to the live electrical parts, the enclosure is further provided with a circumferential air outlet positioned between the front and rear walls. A motor is located in the air inlet area to facilitate its cooling by the entering air. A centrifugal blower impeller is mounted on the blower shaft, with its inlet coinciding with the inlet opening. The impeller is surrounded by a cage shaped heating element consisting of a multitude of inter connected strips of a resistance alloy, which are supported on two plastic rings. The circumferential air outlet is provided with a multitude of guide vanes that help direct and diffuse the air emanating from the heating elements while preventing contact with the heating element from the outside.

15 Claims, 7 Drawing Sheets

Ve
VELOCITY VECTOR DIAGRAM AT TRAILING EDGE OF GUIDE VANES
Vo
VELOCITY VECTOR DIAGRAM AT LEADING EDGE OF GUIDE VANES
Vo
Vr
Vt
VELOCITY VECTOR DIAGRAM AT TIP OF BLOWER BLADES

ELECTRIC AIR HEATER WITH CAGE-SHAPED HEATING ELEMENT COMPRISED OF RESISTANCE ALLOY STRIPS AND INCLINED GUIDE VANES

BACKGROUND OF THE INVENTION

In my U.S. Pat. No. 4,090,061, I described and claimed an electrical air heater which combines a motor driven blower that is surrounded by an 5 electrical resistance heating element consisting of vane like strips which serve both to heat the air and also act as guide vanes to help and redirect the air from the blower.

It was determined through recent testing that the air flow efficiency as claimed in my U.S. Pat. No. 4,090,061 is not realized due to the fact that the air emanating from the heating element is at a high velocity and at a relatively shallow angle to the tangent.

The high air velocities, are responsible for pressure losses, and also generate a noise level that would be undesirable for certain domestic application.

In one embodiment of my above mentioned patent the blower heater combination is surrounded by a blower housing which would alleviate the problem mentioned above by providing a gradual diffusion of the high velocity. The heated air would thus be delivered out of a defined outlet which is very usable in some applications such as a hair dryer, but not so desirable in other applications, as would be discussed herewith.

It has become apparent that there exist many applications where a concentrated stream of heated air would not be required or even desired; instead a low-velocity heated air volume would be more appropriate. In such applications the concentric arrangement of the blower and heating element are still of a great advantage, due to the improved heat transfer properties of the turbulent air flow and the uniformity of the air flow along the entire heating element cylinder. In order to further enhance the aerodynamic efficiency of the system a concentric molded ring of guide-vanes are placed around the heating element. The guide vanes further diffuse the heated air thereby reducing the tangential component of the air velocity converting it to static pressure, according to Bernoulli's theorem.

Applications where a low velocity and therefore silent heated air flow would be of great benefit would include space-heaters, foot warmers, towel drying appliances, flat garment dryers etc. Further on in this specification some such applications would be discussed to illustrate the advantages of the system.

SUMMARY OF THE INVENTION

It is the object of the invention to provide an air heater comprising a blower, heating element and guide-vanes in concentric alignment for the purpose of creating a compact source of heated air.

It is a further object of the invention to provide a source of heated air which is evenly emanated over the entire cylindrical circumference of the air heater.

It is another object to provide a low velocity silent air flow uniformly heated by a source of electric heat.

It is yet another object to provide a shock proof and fire proof housing surrounding the electrical components of the air heater unit.

An electric air heater is disclosed, the electric air heater having a housing, an electric motor mounted to a front wall of the housing, a bladed centrifugal impeller mounted on a motor shaft, a cylindrical caged electric heating element and a plurality of guide vanes forming a second stationary cylindrical cage concentrically surrounding the impeller and the electric heating element. More specifically, the housing of the electric air heater is provided with rear and front walls, the front wall having a central air inlet means. The housing is also provided with an air outlet spaced circumferentially between the rear and front walls. The electric motor is mounted to the front wall of the housing and is in concentric alignment with the air inlet means. The electric motor is provided with a motor shaft which extends toward the rear wall. A bladed centrifugal impeller is mounted on the motor shaft and is rotatable about its axis thereby drawing air in an axial direction. Air is exhausted along the cylindrical periphery of the impeller at an air velocity vector. The electric heating element is formed as a cylindrical cage of spaced longitudinal interconnected vanes, each vane having a strip of conductive material of equal width and equal length spaced to surround the bladed centrifugal impeller. The conductive strips are dimensioned and arranged substantially parallel to the impeller's velocity vector so that the emerging velocity vector is substantially the same as the velocity vector emerging from the impeller. A plurality of guide vanes which form a second stationary cylindrical cage concentrically surrounding the impeller and the electric heating element are also provided. Each of the guide vanes has both a generally equal length and equal cross section, so that the guide vanes are substantially parallel to the velocity vector emerging from said conductive strips of the heating element. In this way, the loss of momentum of the air velocity vector emanating from the impeller, the caged electric heating element and the guide vanes is minimized.

DETAILED DESCRIPTION OF THE DRAWINGS

Figure 1:
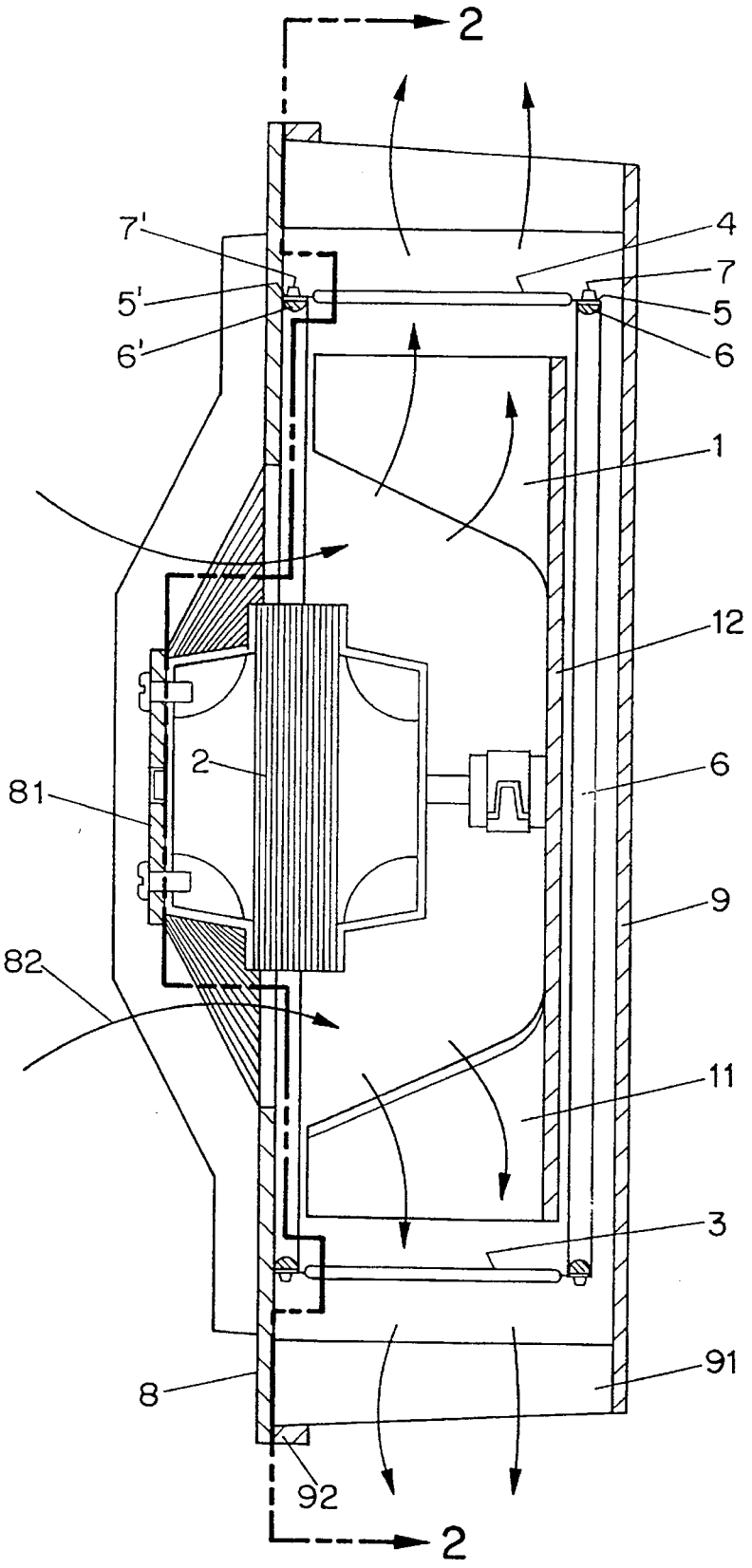
FIG. 1 is a longitudinal cross sectional view of an air heater according to the present invention.
Figure 2:
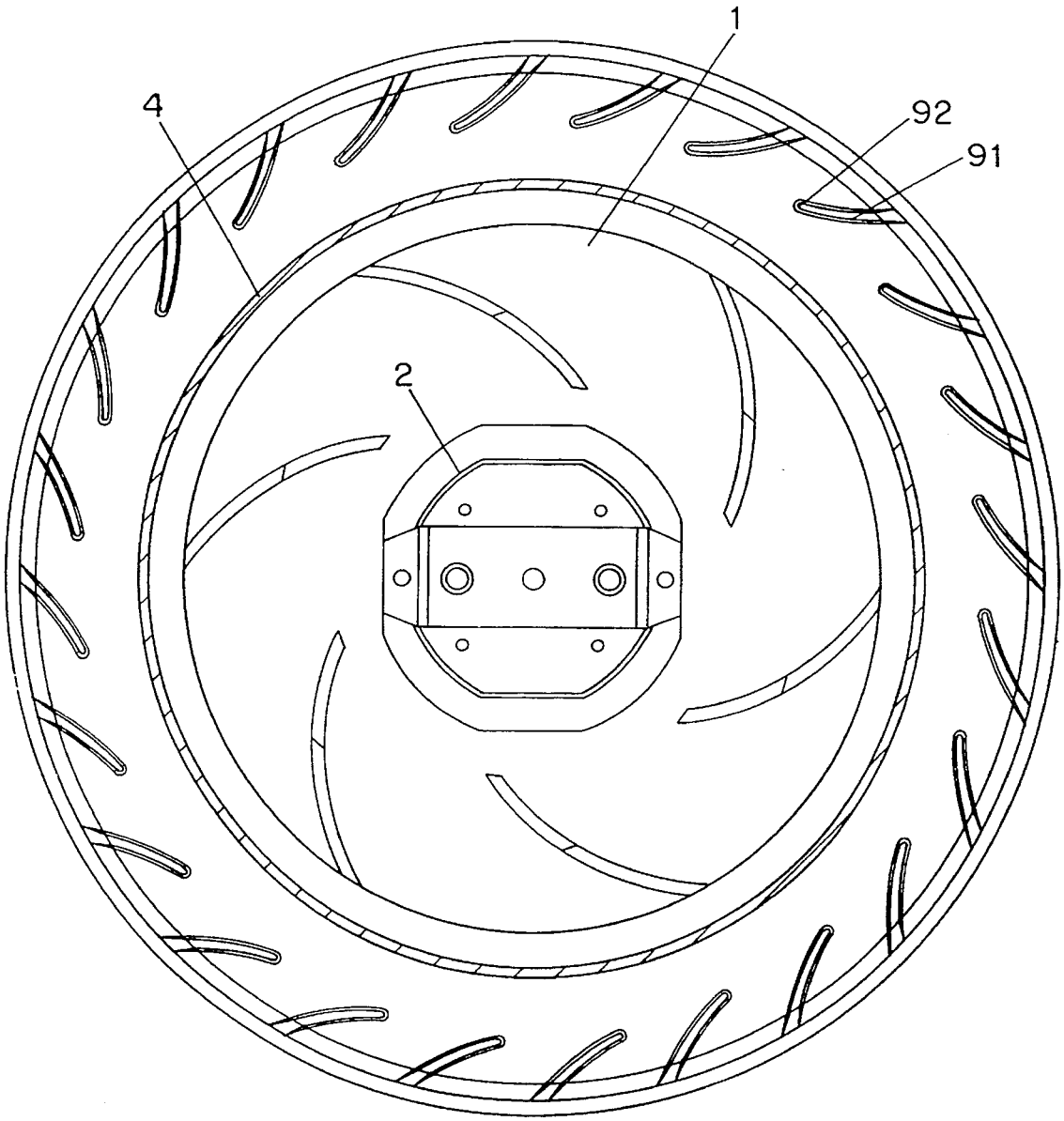
FIG. 2 is a cross sectional view along lines 2—2 of FIG. 1.

Referring first to FIGS. 1 through 4. The air heater according to the invention consists of a centrifugal blower wheel or impeller 1 comprising a back plate 12 and a six blades 11 integrally molded with said back plate which draws in the air in an axial direction and expels it along its cylindrical periphery. The impeller is driven by an electrical motor 2 and turns at a predetermined direction and speed. The air that is expelled from the impeller passes through the strips 4 of the heating elements which are positioned at an angle α substantially parallel to the air flow so as not to cause any impedance of the air flow.

The heating element is similar to the heating element described in my U.S. Pat. No. 4,694,142 which is hereby incorporated herein by reference and European patent #0183252B1 and it's various nationalized derivatives.

The heating element is in the form of a cylindrical cage consisting of many strips 4 of a resistive metal alloy which are stamped to form a zig-zag pattern whereby these strips become connected to each other at their alternate ends 5 and 5'. The ends of the strips are mounted on plastic rings 6 and 6' by partially melting plastic pins that are integral to the rings and forming mushroom heads 7 and 7' that secured the ends of the heater to the rings.

The electrical motor 2 is mounted on the plate 81 which is an integral part of the front wall 8 the plate 81 and is connected to the front wall by a series of integrally molded ribs 82 which are closely spaced to allow air in but to prevent contact with the motor or other electrically live parts.

The rest of the enclosure consists of the rear wall 9 which runs parallel the heater rings and the blower impeller. Rear wall 9 features a second cage consisting of a multitude of integrally molded guide vanes 91 that are inter connected at their free ends by a ring 92 which is integrally molded with the vanes.

Ring 92 is attached to front wall 8 by means of fasteners such as screws, not shown here.

The molded guide vanes that surround the heating element are fashioned in an arcuate manner so that physical access to the heating element is prevented yet the heated air will easily flow through the vanes.

As can be seen in FIG. 1 the entire electrical components are thus enclosed to prevent access. The plastic material that the enclosure is molded of is classified as "flame-retardant" thus fare hazzard is minimized. "Flame-retardant" plastics are much more expensive than other plastic materials. The present design allows that just a small amount of "flame-retardant" plastic is used in comparison with the rest of the plastic materials that constitute the entire appliance. This is obvious if compared to the size of the blower housing in my U.S. Pat. No. 4,090,061 and to the size of the entire fan heater in my U.S. Pat. No. 4,694,142.

Figure 3:
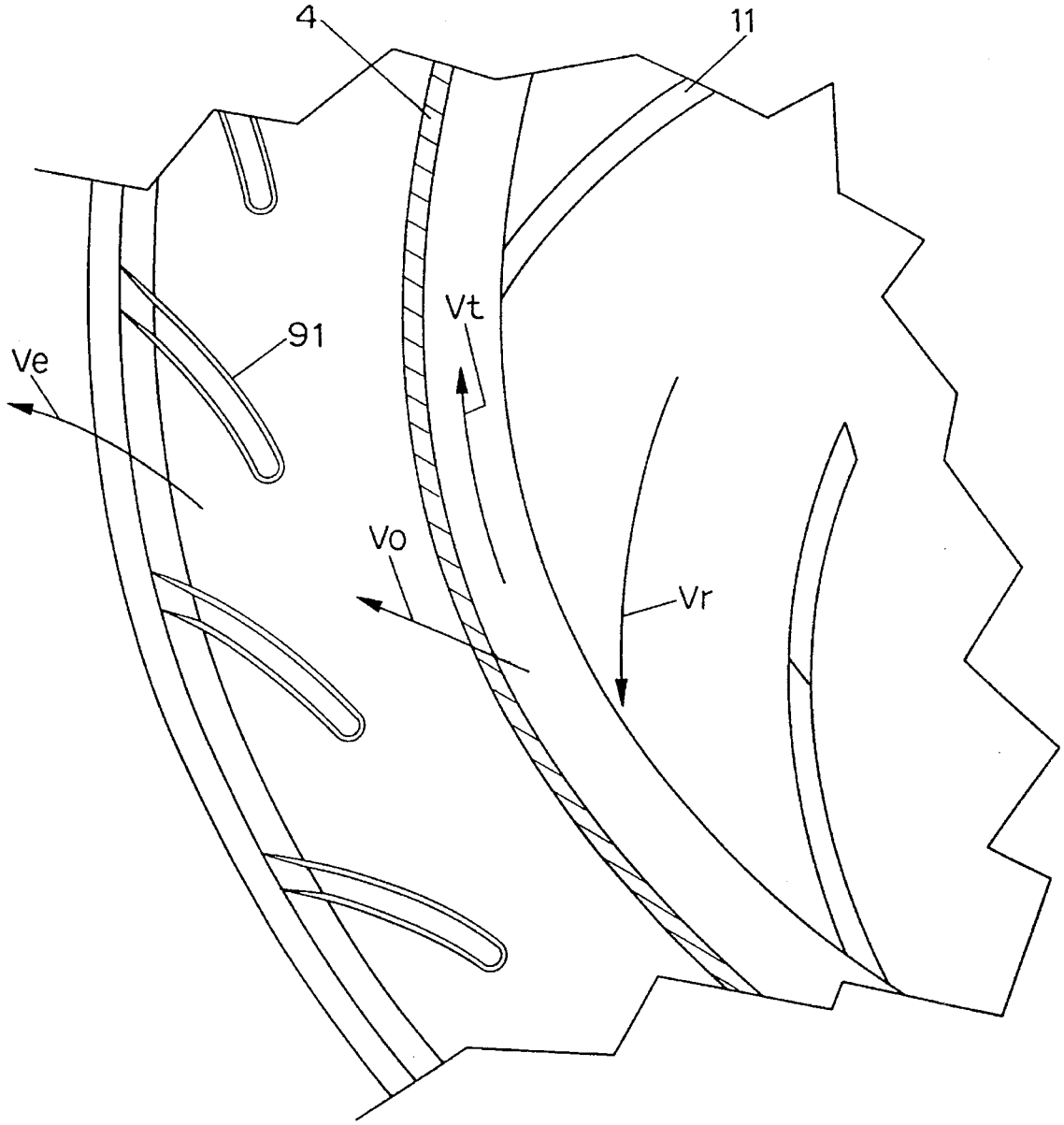
FIG. 3 is an enlargement of the area marked 3 in FIG. 2.
Figure 4:
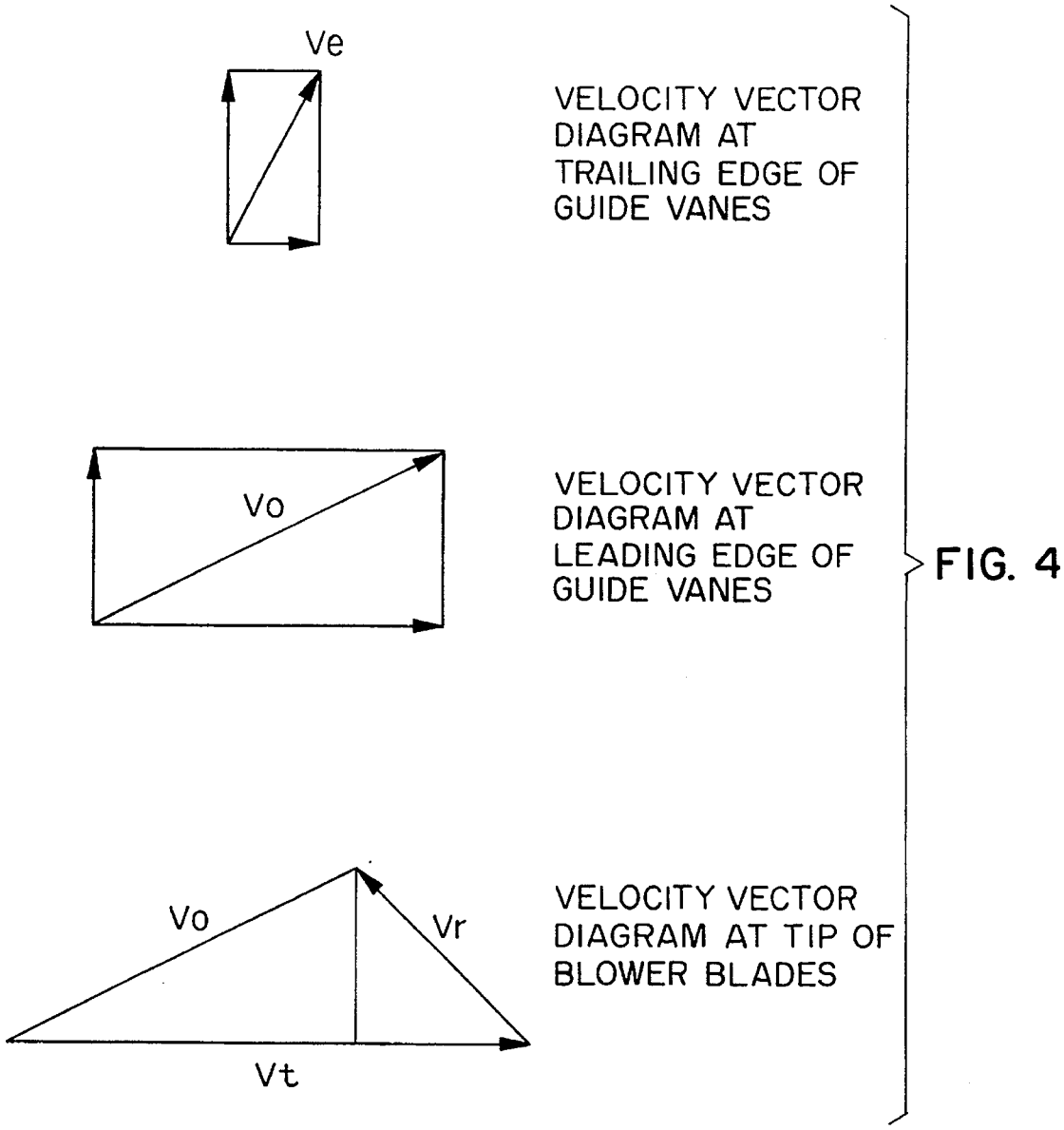
FIG. 4 is a series of velocity vectors of the air flow illustrating flow conditions in the device according to the invention.

Referring now to FIGS. 3 & 4 in which the air flow directions are illustrated. Air that flows through the impeller follows the contour of the blade and will immerge from the impeller at an angle α and velocity as shown in the vector diagram of FIG. 4. Here the air velocity Vo is the resultant of Vr, which is the relative velocity between the air and the blade and Vt, the tangential velocity of the tips of the blades.

The vanes 4 of the heating element are positioned so that they coincide with the direction of the air velocity Vo to minimize loss of momentum. It should be noted that the vanes 4 are slightly curved; this is done primarily to increase the rigidity of the vanes which are made of very thin metal strips.

The velocity vector of the air emerging from the heater vanes is substantially the same as Vo that immerged from the impeller blade. The leading edge 92 of the guide vane 91 substantially coincides with the angle of the vector Vo.

As the air passes through the guide vanes it will change in direction and diminish in velocity, which will result in an increase of its static pressure, as would follow from Bernoulli's equation, as follows:

$$V_o^2/2g+P_o/\gamma=V_e^2/2g+P_e/\gamma$$

Thus $$\Delta p=(P_e-P_o)=\gamma/2g(V_o^2-V_e^2)$$

The gain in pressure (Pe–Po) diminishes the amount of pressure by which the blower needs to raise the air flow thus resulting in a quieter operation, and requiring less power to drive the blower.

Referring back to FIGS. 1 and 2, it becomes apparent that the configuration allows the motor to be cooled by the air being drawn in by the blower wheel. It can also be observed that the whole package becomes very compact since the electric motor partially fits inside the blower cavity.

Figure 5:
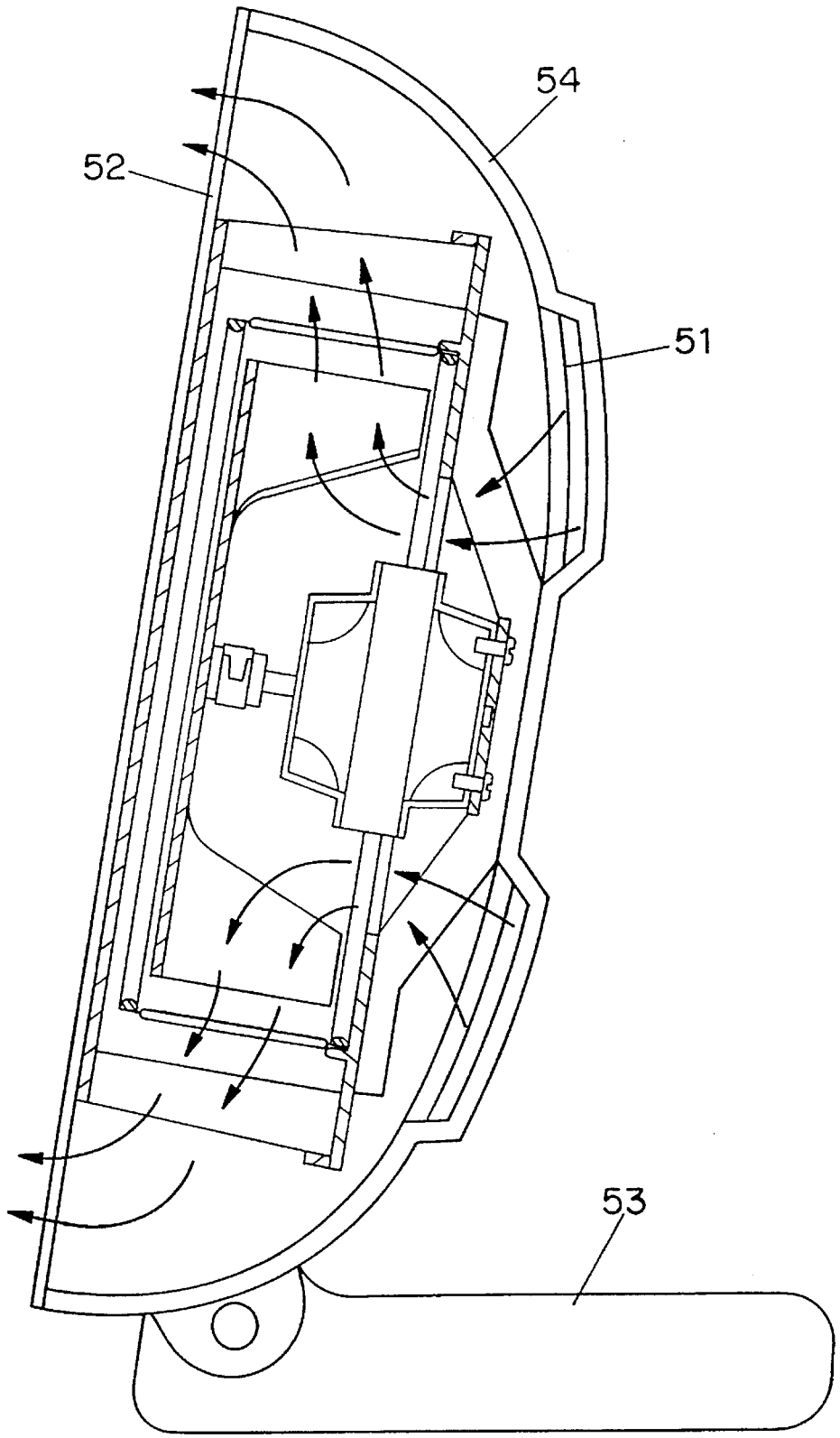
FIG. 5 is a longitudinal cross sectional view of a portable air heater embodying the air heater of the invention.
Figure 6:
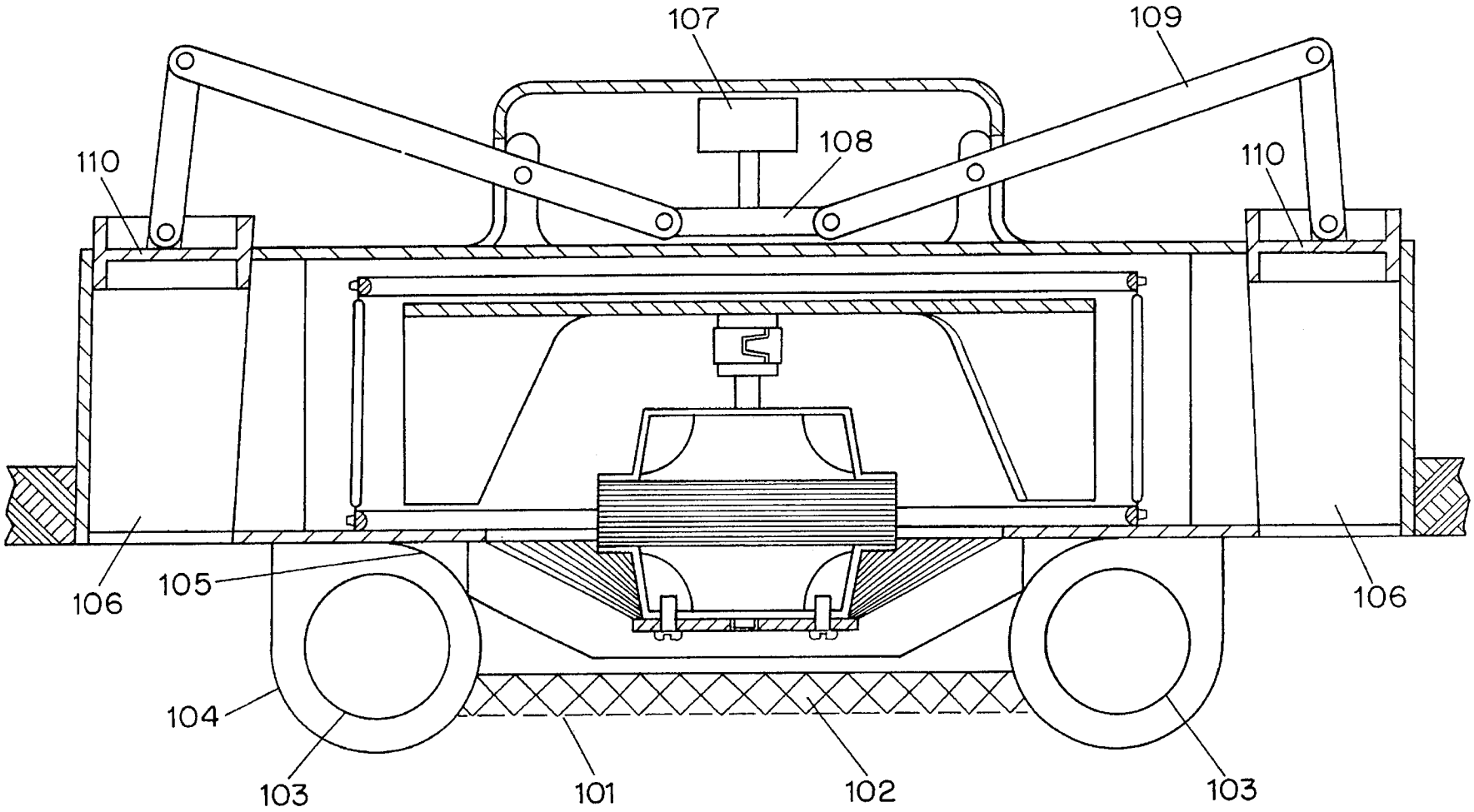
FIG. 6 is a longitudinal cross section through a combination light fixture, heater and exhaust fan, primarily for use in bathrooms, embodying the elements of the invention.
Figure 7A:
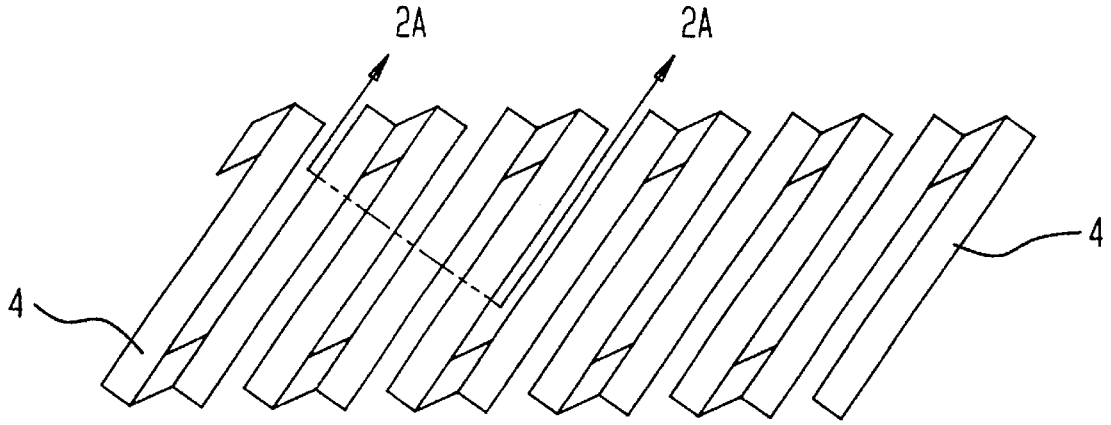
FIG. 7A is an isometric view of the cut-out sheet of resistor material after cutting after folding.
Figure 7B:
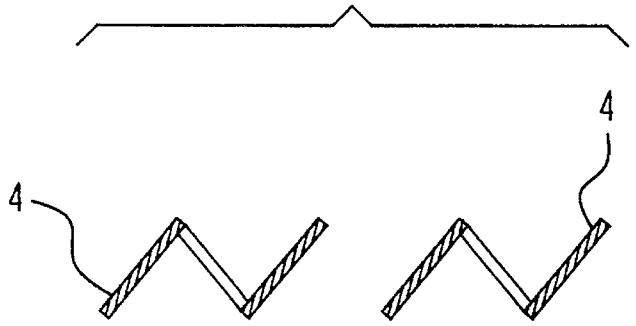
FIG. 7B is a cross section along lines 2A—2A through the folded, cut-out metal sheet shown in FIG. 7A.

FIGS. 5 and 6 illustrate a few applications of the air heater according to the invention that demonstrate the advantages of the system.

FIG. 5 illustrates a free-standing space heater employing the air heater according to the invention. Air is being drawn into the space heater from the rear through the opening 51, after passing through the heating element the heated air is reintroduced into the space through an annular opening 52. The space heater also features a stand 53 that supports the main body 54 of the heater and permits the heater to be tilted in relationship to the base.

FIG. 6 illustrates a combination appliance that incorporates the air heater according to the invention, a ceiling mounted heater, light and exhaust fan suitable for use in bathrooms.

The center portion of the lower face of the appliance features an inlet grille 101 with a filter 102 behind it. The inlet grille is removable for cleaning. Surrounding the grille is a florescent circular light bulb 103 shielded by a clear or "frosted" lense 104 and provided with a reflector 105 to enhance the efficiency of the light source. The air heater according to the invention is positioned coaxially and above the inlet grille 101 and the light bulb 103. The air exiting from the guide vanes 91 can only exit along the annular opening 106 and will thus be returned to the room which will gradually be heated.

When the appliance is to be used as an exhaust fan the heater will not be energized and the solenoid 107 will pull the bar 108 which is attached to the two arms which in turn would lower the annular disc 110 to block the air from returning to the room. Instead, the air is expelled through the new annual opening 106 that was created by the downward movement of the annular disc 110.

It should be borne in mind that the above mentioned applications are only a sampling of the broad use this air heater would have in domestic and industrial fields of heating air.

What is claimed is:

1. An electric air heater comprising:

a housing having a rear wall, a front wall and a periphery defined between said rear and front walls, said front wall having an air inlet means, said periphery defining an air outlet;

an electric motor coupled to said front wall of said housing and in concentric alignment with said air inlet means, said electric motor having a motor shaft extending towards said rear wall, said motor shaft defining an axis;

a bladed centrifugal impeller mounted on said motor shaft and rotatable about said axis for drawing air in an axial direction and exhausting air along the periphery of said impeller at an air velocity having a velocity vector;

an electric heating element in the shape of a first stationary cylindrical cage of spaced longitudinal interconnected vanes, each vane having a strip of conductive material of substantially equal width and substantially equal length spaced to surround said bladed centrifugal impeller, said conductive strips dimensioned and arranged substantially parallel to said velocity vector so that the velocity vector emerging from said conductive strips are substantially the same as the velocity vector emerging from said impeller; and a plurality of guide vanes forming a second stationary cylindrical cage concentrically surrounding said impeller and said electric heating element, each of said guide vanes having a substantially equal length and a substantially equal cross section.

2. The electric air heater of claim 1, wherein said guide vanes are substantially parallel to said velocity vector emerging from said conductive strips of said heating element.

3. The electric air heater of claim 2, wherein said conductive strips of said heating element and said bridging portions are connected to each other to form a zig-zag pattern so that the strips are connected to each other at alternate ends.

4. The electric air heater of claim 1, wherein said electric heating element is formed from an electric resistance alloy, said conductive strips being interconnected by bridging portions of conductive material.

5. The electric air heater of claim 1, wherein said air inlet is formed of a plurality of flat strips of non-conductive material, said flat strips being radially and concentrically aligned across said air inlet.

6. The electric air heater of claim 5, wherein the angle between said trailing edge and the radial axis is substantially less than the angle between said leading edge and said radial axis.

7. The electric air heater of claim 1, wherein said guide vanes have a leading edge, a trailing edge and a radial axis, the angle defined between said radial axis and said leading edge of said guide vane is substantially the same as the angle defined between said radial axis and said conductive strips.

8. The electric air heater of claim 1, wherein said housing which surrounds said electric motor is formed of a fire proof material.

9. The electric air heater of claim 1, wherein said bladed centrifugal impeller comprises a backplate and a blade integrally molded to said backplate.

10. The electric air heater of claim 1, further comprising a means for controlling said electric motor.

11. The electric air heater of claim 1, wherein said guide vanes are integrally molded to a guide vane backplate, said guide vanes having an arcuate shape.

12. The electric air heater of claim 11, further comprising a solenoid for moving said annular disc from said first to said second position.

13. The electric air heater of claim 1 further comprising an exhaust system having an exhaust fan in communication with an interior and exterior space, said exhaust fan further comprises an annular opening annularly surrounding said plurality of guide vanes and an annular disc movable within said annular opening, wherein when said annular disc is in a first venting position, said annular disc prevents the exhausted air from being in communication with said exterior space and when said annular disc is in a second exhaust position, said annular disc prevents the exhausted air from being in communication with said interior space.

14. The electric air heater of claim 1, wherein said bladed centrifugal impeller draws cool air in an axial direction through said air inlet means thereby cooling said electric motor.

15. An electric air heater comprising:

a housing having a rear wall, a front wall and a periphery defined between said rear and front walls, said front wall having an air inlet means, said periphery defining an air outlet;

an electric motor coupled to said front wall of said housing and in concentric alignment with said air inlet means, said electric motor having a motor shaft extending towards said rear wall, said motor shaft defining an axis;

a bladed centrifugal impeller mounted on said motor shaft and rotatable about said axis for drawing air in an axial direction and exhausting air along the periphery of said impeller at an air velocity having a velocity vector;

an electric heating element in the shape of a first stationary cylindrical cage of spaced longitudinal interconnected vines, each vane having a strip of conductive material of substantially equal width and substantially equal length spaced to surround said bladed centrifugal impeller, said conductive strips dimensioned and arranged substantially parallel to said velocity vector so that the velocity vector emerging from said conductive strips are substantially the same as the velocity vector emerging from said impeller;

a plurality of guide vanes forming a second stationary cylindrical cage concentrically surrounding said impeller and said electric heating element, each of said guide vanes having a substantially equal length and a substantially equal cross section; and an exhaust fan in communication with an interior and exterior space, said exhaust fan further comprises an annular opening annularly surrounding said plurality of guide vanes and an annular disc movable within said annular opening, wherein when said annular disc is in a first venting position, said annular disc prevents the exhausted air from being in communication with said exterior space and when said annular disc is in a second exhaust position, said annular disc prevents the exhausted air from being in communication with said interior space.

* * * * *